US006180235B1

(12) United States Patent
Leutner et al.

(10) Patent No.: US 6,180,235 B1
(45) Date of Patent: Jan. 30, 2001

(54) PHOSPHORUS-CONTAINING IRON POWDERS

(75) Inventors: Bernd Leutner, Frankenthal; Gabriele Friedrich, Ludwigshafen; Reinhold Schlegel, Hassloch, all of (DE)

(73) Assignee: BASF Aktiengesellschaft, Ludwigshafen (DE)

( * ) Notice: Under 35 U.S.C. 154(b), the term of this patent shall be extended for 0 days.

(21) Appl. No.: 09/022,672

(22) Filed: Feb. 12, 1998

(30) Foreign Application Priority Data

Feb. 19, 1997 (DE) ..... 19706525

(51) Int. Cl.[7] ..... B32B 5/16; C01G 49/00
(52) U.S. Cl. ..... 428/402; 423/138; 423/322
(58) Field of Search ..... 428/402; 423/138, 423/322

(56) References Cited

U.S. PATENT DOCUMENTS

| | | | | |
|---|---|---|---|---|
| 2,199,944 | * | 5/1940 | Peski | 87/9 |
| 3,110,747 | * | 11/1963 | Mullineaux et al. | 260/683.9 |
| 3,355,439 | * | 11/1967 | Welch et al. | 260/80 |
| 3,438,805 | * | 4/1969 | Potrafke et al. | 117/130 |
| 3,869,453 | * | 3/1975 | Bennett | 260/242 |
| 3,959,220 | * | 5/1976 | Hechenbleikner et al. | 260/45.75 N |
| 4,012,399 | * | 3/1977 | Hechenbleikner et al. | 260/439 R |
| 4,047,983 | * | 9/1977 | Falkowski et al. | 148/105 |
| 4,115,158 | * | 9/1978 | Reen | 148/31.55 |
| 4,152,179 | * | 5/1979 | Falkowski et al. | 148/105 |
| 4,196,136 | * | 4/1980 | Knoth | 60/429.7 |
| 4,201,576 | * | 5/1980 | Haley | 75/132 |
| 4,236,945 | * | 12/1980 | Reen | 148/105 |
| 4,252,672 | * | 2/1981 | Smith | 252/430 |
| 4,588,441 | * | 5/1986 | Ikenoue et al. | 75/230 |
| 4,652,305 | | 3/1987 | Ebenhoech et al. | 75/0.5 |
| 4,929,468 | * | 5/1990 | Mullendore | 427/47 |
| 5,085,690 | | 2/1992 | Ebenhoech et al. | 75/362 |
| 5,796,018 | * | 8/1998 | Moyer et al. | 75/230 |

FOREIGN PATENT DOCUMENTS

| | | |
|---|---|---|
| 409647 | 1/1991 | (EP) . |
| 808163 | 1/1959 | (GB) . |
| 824147 | 11/1959 | (GB) . |

OTHER PUBLICATIONS

*Gmelins Handbuch der Anorg. Chemie*, vol. Iron, Part A, Section II, pp. 1784–1785.

*Ullmann's Enc. of Ind. Chem.*, 5th Edition, vol A14, pp. 596–600.

* cited by examiner

*Primary Examiner*—Hoa T. Le
(74) *Attorney, Agent, or Firm*—Keil & Weinkauf

(57) ABSTRACT

Phosphorus-containing iron powder is prepared by mixing carbonyl iron powder or whiskers with elemental phosphorus, heating the mixture and comminuting the product obtained to give a powder. The powder of the present invention has a particularly low content of extraneous elements.

20 Claims, No Drawings

PHOSPHORUS-CONTAINING IRON POWDERS

FIELD OF THE INVENTION

The present invention relates to phosphorus-containing iron powders and a process for preparing them.

DESCRIPTION OF THE PRIOR ART

Certain applications, for example in powder metallurgy, require metal powders having defined mechanical properties. Suitable powders for such applications are, for example, powders of iron-phosphorus alloys whose mechanical properties such as hardness and brittleness can be set by means of the phosphorus content.

Gmelins Handbuch der Anorganischen Chemie, Volume Iron, Part A, Section II, 8th Edition 1934/39, pages 1784–85 describes classical methods of preparing iron-phosphorus alloys or iron phosphides (having an integral iron-phosphorus ratio). In these methods, iron-phosphorus alloys or iron phosphides are prepared directly from the elements, by reduction of phosphorus oxides in the presence of iron or by coreduction of phosphorus and iron compounds.

Thus, preparations having a phosphorus content of up to 30% by weight can be prepared by melting iron together with red phosphorus under a nitrogen atmosphere or by action of phosphorus vapor on red hot iron. Higher phosphides having a phosphorus content of over 50% by weight are formed on heating the lower phosphides in an atmosphere of saturated phosphorus vapor.

Iron-phosphorus alloys can also be prepared by melting a mixture of iron turnings and $P_2O_5$ with powdered carbon or without addition of carbon. Iron-phosphorus alloys and iron phosphides are also formed in the reduction of $Fe_3PO_4$ by hydrogen or carbon or in the reduction of a mixture of calcium phosphate and $Fe_2O_3$ by carbon.

The processes mentioned generally require high temperatures. In order to react iron with phosphorus, the former has to be heated at least to red heat. Furthermore, the iron-phosphorus alloys obtained by reduction have a high content of secondary constituents.

The production of phosphorus by reduction of phosphate-containing iron ores in an electric furnace produces an alloy of iron and phosphorus, ferrophosphorus, containing from 20 to 27% by weight of phosphorus, as by-product. Secondary constituents present in ferrophosphorus are 1–9% of silicon and further metals such as titanium, vanadium, chromium and manganese.

The iron-phosphorus alloys produced by the abovementioned processes are unsuitable for applications in which high-purity iron powders having a defined phosphorus content and particle sizes of <50 $\mu$Am are required.

SUMMARY OF THE INVENTION

It is an object of the present invention to provide a process for preparing phosphorus-containing iron powder having a phosphorus content which can be varied within wide limits and having a proportion of secondary constituents which is as low as possible.

We have found that this object is achieved by starting out from known processes for preparing phosphorus-containing iron powder in which metallic iron is heated with elemental phosphorus and the product obtained is comminuted to give a powder and, according to the present invention, using metallic iron in the form of finely divided carbonyl iron.

For the purposes of the present invention, finely divided carbonyl iron is carbonyl iron powder and/or carbonyl iron whiskers.

DETAILED DESCRIPTION OF THE INVENTION

Carbonyl iron powder and carbonyl iron whiskers can be obtained according to known processes by thermal decomposition of iron pentacarbonyl in the gas phase, as described, for example, in Ullmann's Encyclopedia of Industrial Chemistry, 5th Edition, Vol. A 14, page 599 or in DE 3 428 121 or in DE 3 940 347, and consist of particularly pure metallic iron. The high purity of the powder or whiskers is the result of the high purity of the iron pentacarbonyl. Powder or whiskers are formed depending on the decomposition conditions (pressure, temperature).

Carbonyl iron powder is a gray, finely divided powder of metallic iron having a low content of secondary constituents and consisting essentially of spherical particles having a mean particle diameter up to 10 $\mu$m.

In the process of the present invention, it is possible to use mechanically hard, unreduced carbonyl iron powders or mechanically soft, reduced carbonyl iron powders.

The unreduced carbonyl iron powders which are preferably used in the process of the present invention have an iron content of >97% by weight, a carbon content of <1.0% by weight, a nitrogen content of <1.0% by weight and an oxygen content of <0.5% by weight. The mean diameter of the powder particles is preferably from 1 to 10 $\mu$m, particularly preferably from 1.5 to 5.0 $\mu$m, and their specific surface area (BET) is preferably from 0.2 to 2.5 $m^2/g$.

The reduced carbonyl iron powders which are preferably used in the process of the present invention have an iron content of >99.5% by weight, a carbon content of <0.06% by weight, a nitrogen content of <0.1% by weight and an oxygen content of <0.4% by weight. The mean diameter of the powder particles is preferably 1–8 $\mu$m, particularly preferably 4.0–8.0 $\mu$m. The specific surface area of the powder particles is preferably 0.2–2.5 $m^2/g$.

Carbonyl iron whiskers are very fine, polycrystalline iron threads. The carbonyl iron whiskers which are preferably used in the process of the present invention consist of thread-like arrangements of spheres having sphere diameters of 0.1–1 $\mu$m, with the threads being able to have different lengths and being able to form tangles or knots, and have an iron content of >83.0% by weight, a carbon content of <8.0% by weight, a nitrogen content of <4.0% by weight and an oxygen content of <7.0% by weight.

The carbonyl iron powders and whiskers which are preferably used in the process of the present invention have a very low content of extraneous metals which is usually below the detection limit of atomic absorption analysis and is the result of their preparation from the very pure starting compound iron pentacarbonyl. The carbonyl iron powders contain, inter alia, the following proportions of further extraneous elements: nickel <100 ppm, chromium <150 ppm, molybdenum <20 ppm, arsenic <2 ppm, lead <10 ppm, cadmium <1 ppm, copper <5 ppm, manganese <10 ppm, mercury <1 ppm, sulfur <10 ppm, silicon <10 ppm and zinc <10 ppm.

Preference is given to using carbonyl iron powder in the process of the present invention.

Elemental phosphorus can be used in all known modifications, ie. as white, red, black or violet phosphorus. In the process of the present invention, preference is given to using red phosphorus. The red phosphorus used in the process of the present invention can additionally contain, in particular, water as a secondary constituent.

The reaction is carried out at a temperature above room temperature. For example, the reaction vessel used can be a heatable tube made of a heat-resistant material such as quartz. Carbonyl iron powder or whiskers and elemental phosphorus are intensively mixed and the reaction mixture of carbonyl iron powder or whiskers and elemental phosphorus is heated in the reaction vessel until the exothermic reaction commences. After the reaction has commenced, the temperature can rise further as a result of the heat of reaction. The reaction is preferably carried out at above 300° C., particularly preferably at from 380° C. to 550° C.

The reaction is preferably carried out under substantial exclusion of atmospheric oxygen. This can be achieved, for example, by carrying out the reaction in an inert gas atmosphere. The reaction is preferably carried out in an inert gas atmosphere of nitrogen, and is preferably carried out at atmospheric pressure.

An advantage of the process of the present invention is that the iron/phosphorus ratio of the powder can be varied as desired by selection of the starting composition.

Carbonyl iron powder and phosphorus are preferably reacted in a mass ratio of from 99.9:0.1 to 30:70, particularly preferably from 99:1 to 70:30.

Depending on the starting composition selected, the phosphorus content of the phosphorus-containing iron powder obtained can be from 0.1 to 80% by weight. It is preferably from about 0.5 to 20% by weight, particularly preferably from about 1 to 10% by weight.

Another advantage of the process of the present invention is, as a result of the purity of the starting materials, the low content of secondary constituents in the powder obtained. The amount of the elements Ni, Cr, Mo, As, Pb, Cd, Cu, Mn, Hg, S, Si and Zn present in the phosphorus-containing iron powder of the present invention is, when using high-purity phosphorus, limited essentially by the amount of these elements present in the carbonyl iron powder used. In general, the total content of extraneous elements other than oxygen is below 0.1%. The total amount of these elements can be below 0.035% by weight. The carbon content of the powder is preferably below 5% by weight, particularly preferably below 1% by weight. The nitrogen content of the powder is preferably below 5% by weight, particularly preferably below 1% by weight, and the hydrogen content of the powder is preferably below 1% by weight, particularly preferably below 0.5% by weight, most preferably below 0.4% by weight.

The amounts of further extraneous elements present in the powder are preferably below the abovementioned limits for carbonyl iron powder. Furthermore, the phosphorus-containing iron powder can be substantially freed of carbon, oxygen and nitrogen by heating in a stream of hydrogen according to known processes, as are described, for example, in Ullmann's Encyclopedia of Industrial Chemistry, Fifth Edition, Vol. A 14, p. 599. In this way, the carbon content can be reduced to below 0.1% by weight and the nitrogen content can be reduced to below 0.01% by weight.

A further advantage is the low reaction temperature which is probably attributable to the large specific surface area of the finely divided carbonyl iron powder and whiskers used.

The product obtained is then comminuted mechanically, for example by milling, to give a powder wherein the phosphorous-containing iron preferably has mean particle size of less than 10 $\mu$m.

The mechanical properties of the phosphorus-containing iron powder of the present invention are determined, in particular, by its phosphorus content. The powder is therefore particularly advantageously used for applications in which defined mechanical properties such as hardness or brittleness are required.

Preferred applications of the phosphorus-containing iron powder of the present invention are in the field of powder metallurgy. Powder metallurgy is a specific field of materials production and processing in which pulverulent metallic materials are pressed and/or sintered to form shaped bodies. Preferred applications are, for example, die pressing and metal injection molding.

The phosphorus-containing iron powder of the present invention can be used alone or as a mixture with other metal powders, eg. of nickel, cobalt or bronze, for producing iron alloys.

According to the abovementioned methods, the finely divided phosphorus-containing iron of the present invention can also be used, for example, for the embedding of industrial diamonds in cutting and grinding tools and also for producing metal ceramics, known as cermets.

The invention is illustrated by the following examples.

EXAMPLE 1

A rotary tube of quartz glass is charged with 45.0 (0.806 mol) of mechanically hard carbonyl iron powder HS 5103 (BASF AG, Ludwigshafen, Germany) having a mean particle diameter of about 3 $\mu$m and 5.0 g (0.161 mol) of red phosphorus (Merck Darmstadt, Germany) which have been well mixed beforehand. The apparatus is first flushed with $N_2$ and then heated at 530° C. for about 1 h while passing $N_2$ through it.

During the experiment, a stream of nitrogen (10 l/h) is passed through the tube. The temperature is measured by means of thermocouples, one of which indicates the furnace temperature and a second, which projects directly into the powder, indicates the temperature of the reaction mixture.

An exothermic reaction commences at about 450° C., which is indicated by a rise in the temperature of the reaction mixture to about 550° C. within a few minutes. The formation of the iron-phosphorus alloy is then complete, which is indicated by a decrease in the temperature. The powder is then allowed to cool to room temperature. 48.2 g of gray, caked powder are removed from the tube and the product is crushed in air. It has the following elemental composition:

Fe 85.0; P 8.1; C 0.5; O 7.0; H<0.5; N 0.24 [% by weight].

EXAMPLE 2

The preparation described in Example 1 is repeated, but using 36.0 g (0.645 mol) of mechanically soft carbonyl iron powder SM 6256 (BASF AG, Ludwigshafen, Germany) having a mean particle diameter of about 3 $\mu$um and 4.0 g (0.129 mol) of red phosphorus (Merck Darmstadt, Germany). This gives 40.1 g of a gray, caked product which has the following elemental composition:

Fe 88.3; P 7.9; C<0.5; O 3.6; H<0.5; N 0.24 [% by weight].

EXAMPLE 3

90 kg of mechanically hard carbonyl iron powder having a mean particle diameter of about 3 $\mu$m and 10 kg of red phosphorus (Hoechst-Knapsack) are intensively mixed. The mixture is placed on a metal sheet and introduced into a furnace made inert with nitrogen where it is heated to about 420° C. over a period of 2 hours. The commencement of the reaction at about 420° C. heats the mixture further. The heating is switched off, the product is cooled to room temperature and taken out as a slightly caked gray powder. This powder is comminuted to a mean particle diameter of about 5 μm in a mill using steel milling media.

The product has the following elemental composition:

Fe 89.1; P 9.8; C 0.59; N 0.04 [% by weight].

The iron powders prepared as described in Examples 1–3 comprise, according to X-ray powder diffractometry, iron and iron phosphides of differing stoichiometry (FeP, $Fe_2P$ and $Fe_3P$).

We claim:

1. A process for preparing phosphorus-containing iron powder, in which metallic iron is mixed with elemental phosphorus and heated and the product obtained is comminuted to give a powder, wherein the metallic iron is used in the form of finely divided carbonyl iron.

2. The phosphorus-containing iron powder produced by the process of claim 1.

3. A process as defined in claim 1 carried out at a temperature above 300° C.

4. The phosphorus-containing iron powder produced by the process of claim 3.

5. A process as defined in claim 1, wherein finely divided carbonyl iron is heated with elemental phosphorus in an inert gas atmosphere.

6. The phosphorus-containing iron powder produced by the process of claim 5.

7. A process as defined in claim 1, wherein the elemental phosphorus is used in the form of red phosphorus.

8. The phosphorus-containing iron powder produced by the process of claim 7.

9. A process as defined in claim 1, wherein the finely divided carbonyl iron used is carbonyl iron powder having the features carbon content below 1% by weight, nitrogen content below 1% by weight oxygen content below 0.5% by weight, total content of further extraneous elements below 0.1% by weight and the iron powder consists essentially of iron and phosphorous.

10. The phosphorus-containing iron powder produced by the process of claim 9.

11. A process as defined in claim 10, wherein the finely divided carbonyl iron used is carbonyl iron powder having the features carbon content below 0.06% by weight nitrogen content below 0.1% by weight oxygen content below 0.4% by weight total content of further extraneous elements below 0.1% by weight.

12. The phosphorus-containing iron powder produced by the process of claim 11.

13. A process as defined in claim 1, wherein finely divided carbonyl iron is heated with elemental phosphorus in a mass ratio of from 99:1 to 70:30.

14. The phosphorus-containing iron powder produced by the process of claim 13.

15. A process as defined in claim 1, wherein the finely divided carbonyl iron used is carbonyl iron powder having the features carbon content below 1% by weight, nitrogen content below 1% by weight, oxygen content below 0.5% by weight, total content of further extraneous elements below 0.1% by weight and the phosphorous-containing iron powder contains up to 89% of weight iron.

16. A process as defined in claim 1, wherein the finely divided carbonyl iron used is carbonyl iron powder having the features carbon content below 1% by weight, nitrogen content below 1% by weight, oxygen content below 0.5% by weight, total content of further extraneous elements below 0.1% by weight and the phosphorous-containing iron powder has an oxygen content of up to 7% by weight.

17. A phosphorous-containing iron powder consisting essentially of iron and phosphorous and having a phosphorous content from 0.1 to 80% by weight, carbon content below 1% by weight, nitrogen content below 1% by weight, hydrogen content below 0.5% by weight, total content of further extraneous elements other than oxygen below 0.1%, mean particle diameter <10 μm, able to be prepared by a process as claimed in claim 1.

18. A phosphorous-containing iron powder as claim in claim 17 consisting essentially of iron and phosphorous and having a carbon content below 0.06% by weight, nitrogen content below 0.1% by weight, hydrogen content below 0.4% by weight.

19. A phosphorous-containing iron powder having an iron content of up to 89% by weight, phosphorous content from 0.1 to 80% by weight, carbon content below 1% by weight, nitrogen content below 1% by weight, hydrogen content below 0.5% by weight, total content of further extraneous elements other than oxygen below 0.1%, mean particle diameter <10 μm, able to be prepared by a process as claimed in claim 1.

20. A phosphorous-containing iron powder having an iron content of up to 89% by weight, phosphorous content from 0.1 to 80% by weight, carbon content below 1% by weight, nitrogen content below 1% by weight, hydrogen content below 0.5% by weight, oxygen content of up to 7% by weight, total content of further extraneous elements below 0.1%, mean particle diameter <10 μm, able to be prepared by a process as claimed in claim 1.

* * * * *

UNITED STATES PATENT AND TRADEMARK OFFICE

CERTIFICATE OF CORRECTION

PATENT NO. : 6,180,235 B1
DATED : January 30, 2001
INVENTOR(S) : Leutner et al.

It is certified that error appears in the above-identified patent and that said Letters Patent is hereby corrected as shown below:

Column 5, claim 11,
Line 46, "claim 10" should be -- claim 9 --.

Signed and Sealed this

Twenty-ninth Day of January, 2002

*Attest:*

*Attesting Officer*

JAMES E. ROGAN
*Director of the United States Patent and Trademark Office*